US007048410B2

(12) United States Patent
Kutler

(10) Patent No.: US 7,048,410 B2
(45) Date of Patent: May 23, 2006

(54) SUPPORT AND ENCLOSURE STRUCTURE FOR FLUORESCENT LIGHT BULBS

(76) Inventor: Murray Kutler, 2119 S. 135th Ave., Omaha, NE (US) 68144

( * ) Notice: Subject to any disclaimer, the term of this patent is extended or adjusted under 35 U.S.C. 154(b) by 127 days.

(21) Appl. No.: 10/786,870

(22) Filed: Feb. 25, 2004

(65) Prior Publication Data

US 2005/0185396 A1 Aug. 25, 2005

(51) Int. Cl.
*F21V 7/20* (2006.01)
*F21V 29/02* (2006.01)

(52) U.S. Cl. ..... 362/218; 362/260; 362/373

(58) Field of Classification Search ..... 362/218, 362/217, 221, 222, 223, 260, 294, 373, 264, 362/345, 126, 547, 580
See application file for complete search history.

(56) References Cited

U.S. PATENT DOCUMENTS 4,644,453 A * 2/1987 Vest ..... 362/223
5,140,216 A * 8/1992 Darr ..... 362/223
5,528,477 A * 6/1996 Carmo ..... 362/260
5,909,953 A * 6/1999 Shima ..... 362/260

* cited by examiner

*Primary Examiner*—Ali Alavi
*Assistant Examiner*—Bao Q. Truong
(74) *Attorney, Agent, or Firm*—Adam H. Jacobs

(57) ABSTRACT

A support and enclosure structure for fluorescent light bulbs includes an elongated, hollow tube having opposite ends, an outer wall and an inner volume, and at least one ventilation opening extending through the outer wall for permitting air flow between the inner volume of the tube and the surrounding environment for cooling of the fluorescent light bulb held there within. End caps are mounted on opposite ends of the tube, the end caps adapted to engage opposite ends of the fluorescent light bulb and support the fluorescent light bulb within the inner volume of the tube free of contact with the outer wall of the tube. Finally, the tube is constructed of a generally rigid, at least partially translucent materials, such that light emitted by the fluorescent light bulb held within the tube generally radiates through the outer wall of the tube into the surrounding environment.

11 Claims, 4 Drawing Sheets

SUPPORT AND ENCLOSURE STRUCTURE FOR FLUORESCENT LIGHT BULBS

BACKGROUND OF THE INVENTION

1. Technical Field

The present invention relates generally to support devices for lights and, more particularly, to a support and enclosure structure for fluorescent light bulbs which includes an elongated hollow tube having opposite ends, an outer wall and an inner volume, at least one ventilation opening extending through the outer wall for permitting air flow between the inner volume of the tube and the surrounding environment for cooling of the fluorescent light bulb held within the tube, end caps mounted on opposite ends of the tube which engage the opposite ends of a fluorescent light bulb and support the light bulb within the inner volume of the tube free of contact with the outer wall of the tube and the tube being constructed of a generally rigid, at least partially translucent material such that light emitted by the fluorescent light bulb is viewable through the outer wall of the elongated hollow tube.

2. Description of the Prior Art

Fluorescent lights are used in many different situations for lighting purposes. In general, the standard fluorescent lamp design includes a generally hollow airtight glass tube which is filled with an inert gas such as Argon with the outer wall of the glass tube being coated with a phosphor substance and further includes a pair of electrodes mounted at opposite ends of the airtight tube. When the fluorescent light is turned on and current is passed through the electrodes, both electrode filaments heat up very quickly, boiling off electrons, which ionize the gas in the tube, thus establishing an electrical arc which excites mercury atoms held within the tube, thus triggering the illumination process. Of course, there are other types of fluorescent light bulbs and fluorescent light fixtures, but each of them have in common a phosphor-coded translucent glass tube in which the inert gas is held. The problem with most fluorescent lights, and, in particular, fluorescent light bulbs, is this glass tube which is very prone to breakage during installation or removal of the fluorescent bulb from the fluorescent light fixture. There is therefore a need for a support and protection structure which can be used in connection with fluorescent light bulbs to provide an easy-to-handle structure which may be quickly and easily fitted into a light fixture while significantly reducing the chance for breakage of the bulb.

Another problem encountered in the use of fluorescent light bulbs is the excessive amount of heat which can be emitted by the bulb, particularly in the case of the currently available high-intensity fluorescent light bulbs. Unless the heat generated by the bulb is allowed to dissipate, the lifespan of the fluorescent bulb may be severely compromised which detracts from the usefulness of the fluorescent bulb and makes operation of the unit that much more expensive. It has further been found that the heat dissipation problems encountered with fluorescent light bulbs being used with standard lighting fixtures are exacerbated when the air space surrounding the light bulb is restricted, as would occur if the bulb were contained within a protective enclosure or the like. There is therefore a need for ventilation openings in the walls of any enclosing structure which will permit the heat generated by the high-intensity fluorescent bulb to be quickly and easily dissipated. Another beneficial feature of fluorescent bulbs is that they may be, in general, quickly and easily removed and replaced upon the bulb burning out. However, removal and replacement of the fluorescent bulb entails some degree of danger due to the elongated glass tube which comprises the fluorescent light bulb, as the elongated glass tube is easily shattered and broken by any type of contact or excessive stress. Furthermore, the ease with which the fluorescent light bulb may be removed and replaced is almost entirely dependent on the location of the fluorescent light fixture, and, in the event of the fluorescent light fixture being in a fairly inaccessible area, removal and replacement of a bulb can be very difficult. Removal and replacement of the bulb is facilitated, however, if the connection of the bulb to the light fixture is improved and, furthermore, the removal and replacement of the fluorescent bulb is greatly simplified if a connection to the fluorescent fixture ballast is made easier. There is therefore a need for a support and enclosure structure for a fluorescent light bulb which can be quickly and easily removed from a light fixture and which may be quickly and easily connected to the ballast of the light fixture once the fluorescent bulb is mounted within the light fixture.

Therefore, an object of the present invention is to provide an improved support and enclosure structure for fluorescent lights.

Another object of the present invention is to provide a support and enclosure structure for fluorescent lights which includes an elongated hollow tube having opposite ends, an outer wall and an inner volume and end caps which mount to opposite ends of the hollow tube, the end caps engaging and supporting a fluorescent light bulb therebetween to support the light bulb within the inner volume of the hollow tube without contacting the outer wall of the tube.

Another object of the present invention is to provide a support and enclosure structure for fluorescent lights which includes at least one ventilation opening extending through the outer wall for permitting air flow between the inner volume of the tube and the surrounding environment for cooling of the fluorescent light bulb held there within.

Another object of the present invention is to provide a support and enclosure structure for fluorescent lights which may be quickly and easily mounted within a fluorescent light fixture and which can be connected to the fluorescent light fixture ballast after the support and enclosure structure is mounted therewithin.

Another object of the present invention is to provide a support and enclosure structure for fluorescent lights in which the hollow tube is constructed of a generally rigid, at least partially translucent material such that light emitted by a fluorescent light bulb held within the tube generally radiates through the outer wall of the tube into the surrounding environment.

Finally, an object of the present invention is to provide a support and enclosure structure for fluorescent lights which is relatively simple to manufacture and is safe and efficient in use.

SUMMARY OF THE INVENTION

The present invention provides a support and enclosure structure for fluorescent light bulbs which includes an elongated, hollow tube having opposite ends, an outer wall and an inner volume, and at least one ventilation opening extending through the outer wall for permitting air flow between the inner volume of the tube and the surrounding environment for cooling of the fluorescent light bulb held therewithin. End caps are mounted on opposite ends of the tube, the end caps adapted to engage opposite ends of the fluo rescent light bulb and support the fluorescent light bulb within the inner volume of the tube free of contact with the outer wall of the tube. Finally, the tube is constructed of a generally rigid, at least partially translucent material, such that light emitted by the fluorescent light bulb held within the tube generally radiates through the outer wall of the tube into the surrounding environment.

As thus described, the support and enclosure structure for fluorescent light bulbs of the present invention provides a substantial improvement over those protective devices found in the prior art. For example, the support and enclosure structure of the present invention may be quickly and easily removed from the fluorescent light fixture and, once removed, the fluorescent light bulb held there within may be replaced while the support and enclosure structure is in a far more accessible location. Once the bulb is replaced, the support and enclosure structure can then be put back into the fluorescent light fixture, thus greatly facilitating the removal and replacement of the fluorescent light bulb. Also, the ventilation opening extending through the outer wall of the hollow tube permits air flow between the inner volume of the tube and the surrounding environment, thus cooling the fluorescent light bulb held therewithin which extends the lifespan of the fluorescent light bulb and greatly reduces the risk of fire due to excessive heat caused by the bulb. Finally, because the hollow tube is constructed of a generally rigid material such as plastic or a resin-based material, there is far less concern with breakage of the fluorescent light bulb during installation and removal from the fluorescent light fixture which greatly reduces the chance for injury due to breakage of the bulb. It is thus seen that the support and enclosure structure for fluorescent light bulbs of the present invention provides a substantial improvement over those devices found in the prior art.

DESCRIPTION OF THE PREFERRED EMBODIMENT

The support and enclosure structure 10 for fluorescent light bulbs of the present invention is best shown in FIGS. 1–4 as including an elongated hollow tube 12 which, in the preferred embodiment, would have a length of approximately six inches to four feet, and a diameter of approximately one-half inch to three inches, depending on the bulb size which is to be retained within the support and enclosure structure 10. The thickness of outer wall 14 would vary accordingly, although in any circumstance it is preferred that the outer wall 14 be of sufficient thickness to provide structural rigidity to the hollow tube 12 to provide appropriate protection for the fluorescent light bulb 50 retained within the hollow tube 12. It is further preferred that hollow tube 12 be constructed of a sturdy plastic or resin-based material which would be molded into the hollow tube shape by any standard plastic formation technique used in the art. Furthermore, it is preferred that the hollow tube 12 be at least partially translucent to permit the light emitted by the fluorescent light bulb 50 to radiate through the outer wall 14 of hollow tube 12 into the surrounding environment. The precise level of translucence, color, and other light-passing characteristics of the hollow tube 12 may be modified or changed depending on the intended use of the support and enclosure structure 10 of the present invention, any of which would be understood by one skilled in the art of lighting techniques.

Figure 1:
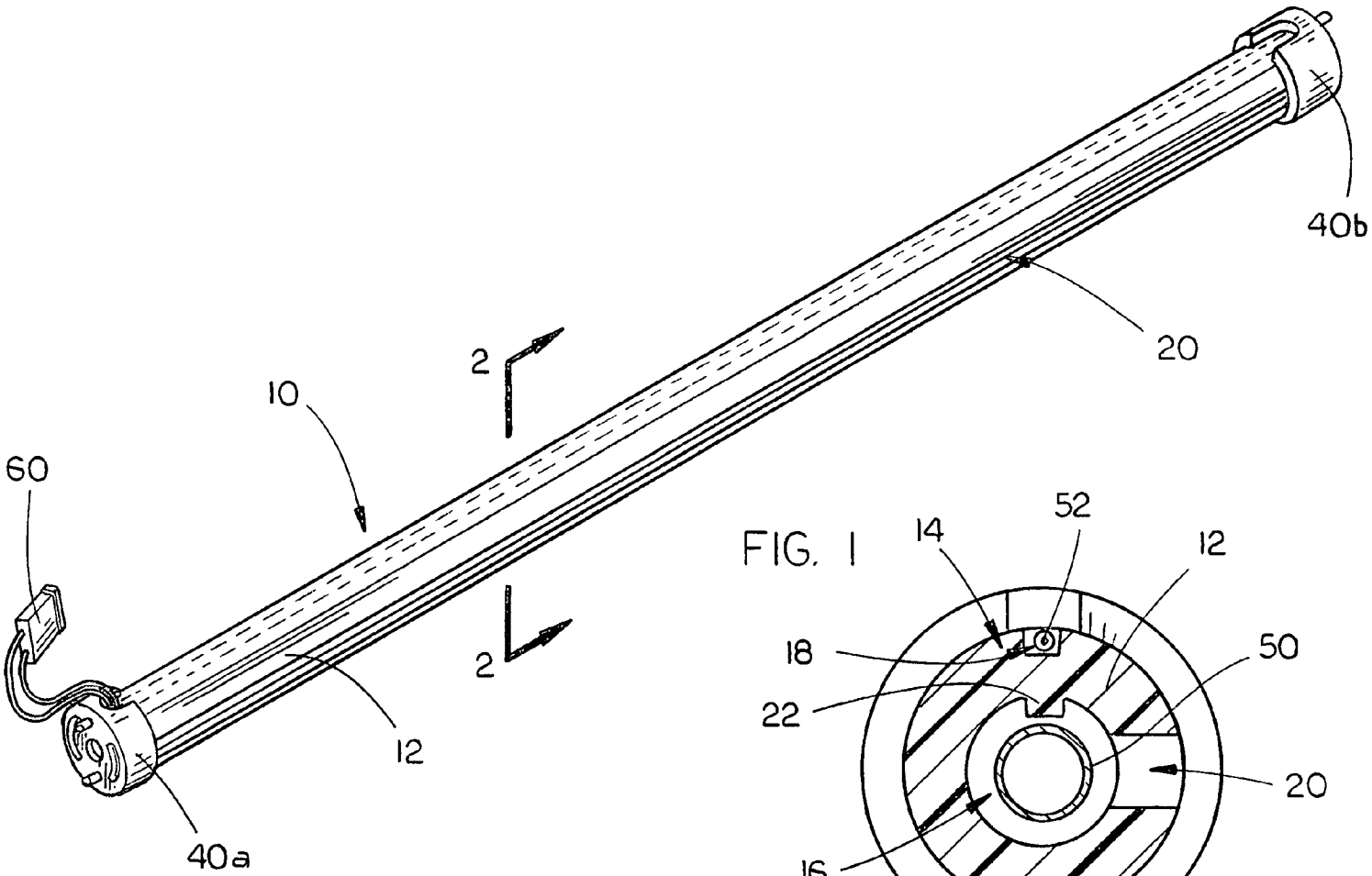
FIG. 1 is a perspective view of the support and enclosure structure for a fluorescent light bulb of the present invention.
Figure 2:
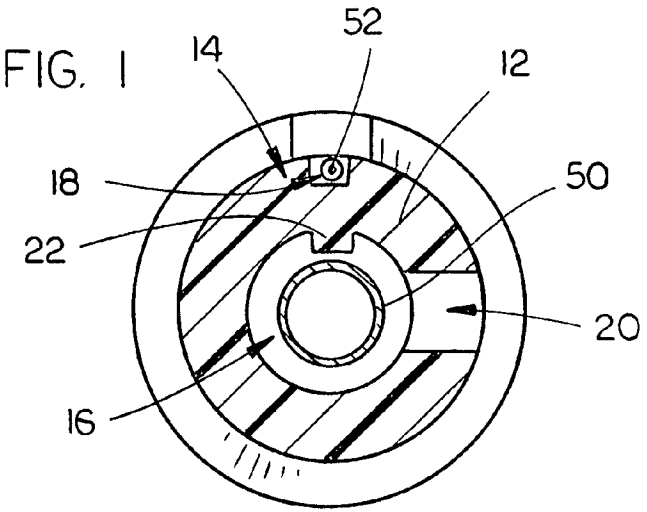
FIG. 2 is a side sectional elevational view taken along line 2—2 of FIG. 1.

In the preferred embodiment, hollow tube 12 would have a generally C-shaped cross sectional shape, as shown best in FIG. 2, with the gap in the outer wall 14 extending between the inner volume 16 of hollow tube 12 and the surrounding environment. This gap forms the ventilation opening 20 which permits air flow between the inner volume 16 of hollow tube 12 and the surrounding environment, thereby providing cooling for the fluorescent light bulb 50 housed within the hollow tube 12. As shown in FIG. 1, the ventilation opening 20 extends along the entire length of hollow tube 12, yet, due to the wall thickness of outer wall 14, the structural rigidity of the hollow tube 12 is not compromised.

Figure 3:
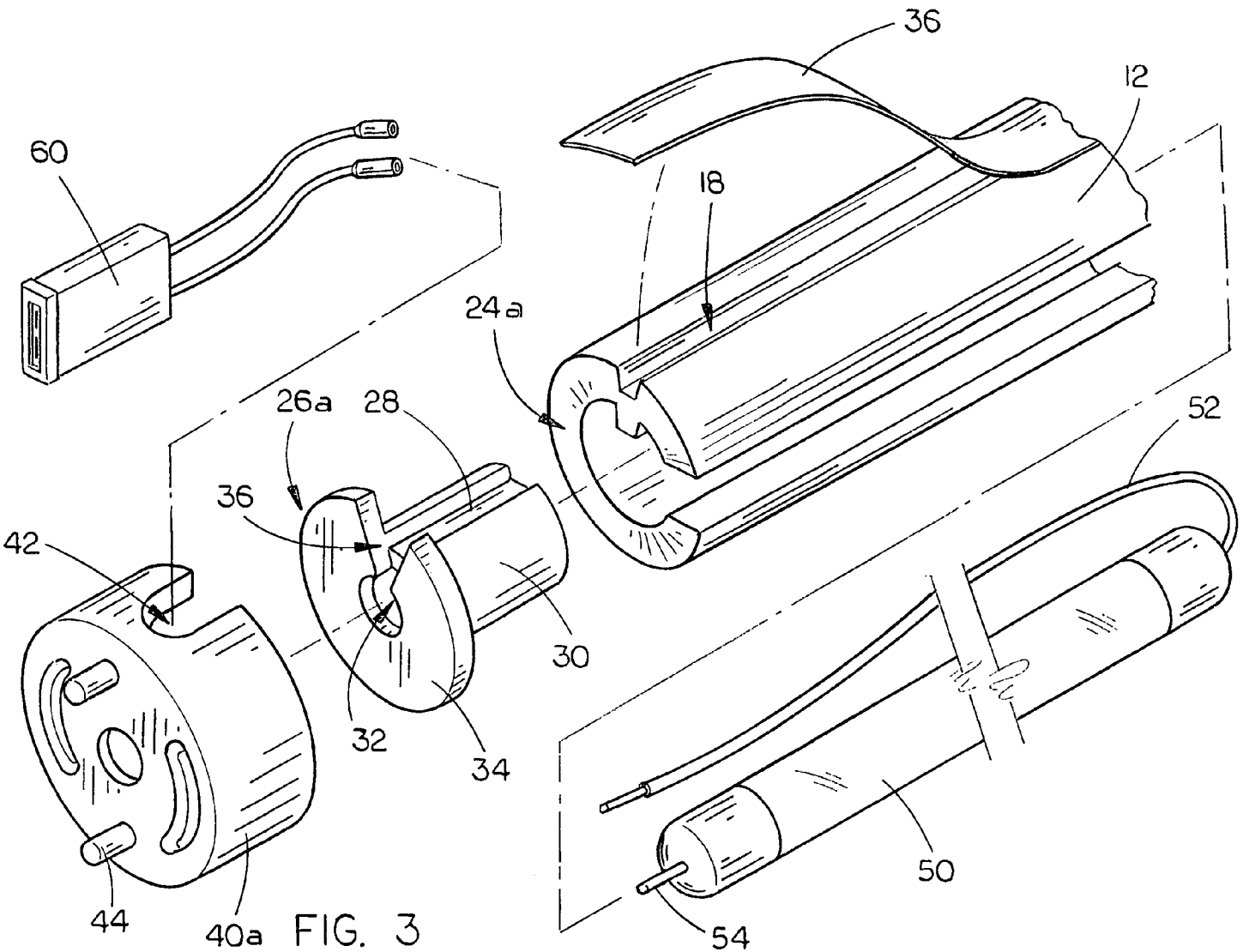
FIG. 3 is a detailed exploded perspective view of the end elements of the support and enclosure structure for fluorescent light bulbs of the present invention.

Formed in the outer surface of outer wall 14 and extending along the length of hollow tube 12 is a wire channel 18, shown best in FIGS. 2 and 3, which provides a channel for electrode wire 52 projecting from fluorescent bulb 50 to run back along the hollow tube 12 yet be safely retained adjacent the hollow tube 12 to prevent accidental damage to the electrode wire 52. Of course, the wire channel 18 is not absolutely necessary to the functioning of the present invention, although it has been found that the inclusion of wire channel 18 greatly decreases the chance for the electrode wire 52 to be damaged. It has further been found that the inclusion of wire channel 18 generally requires a slight thickening of the outer wall 14 on the side of outer wall 14 adjacent inner volume 16, as shown in FIG. 2, in order to maintain the structural rigidity of the hollow tube 12. This wire channel ridge 22 may be formed as part of the manufacturing process for hollow tube 12, or may be added later, although it is preferred that the wire channel ridge 22 be integrally formed with hollow tube 12 in order to maintain the structural rigidity of hollow tube 12. It should be noted, however, that inclusion of the wire channel ridge 22 is not strictly necessary to maintain the structural integrity of the hollow tube 12 in the various embodiments of the present invention.

Mounted on opposite ends 24*a* and 24*b* of hollow tube 12 are a pair of end caps 26*a* and 26*b*, which are shown best in FIG. 3. As the end caps 26*a* and 26*b* are generally identical to one another, the following description of end cap 26*a* should be understood to apply equally to end cap 26*b*. End cap 26*a* is formed as a generally cylindrical plug having an external diameter approximately equal to or slightly greater than the internal diameter of hollow tube 12, and would further include a cut-out section 28 which corresponds with the wire channel ridge 22 as was previously described. The generally cylindrical plug section 30 of end cap 26*a* is hollow and includes an electrode opening 32 which extends generally coaxially through cylindrical plug section 30 of end cap 26*a*. Mounted on the outer end of cylindrical plug section 30 is a flange 34 which prevents the end cap 26*a* from extending too far into the hollow tube 12. The flange 34 would also include a cut-out section 36 which permits the electric wire 52 to extend therethrough. Perhaps the most important feature of end cap 26*a*, however, is that the electrode opening 32 of cylindrical plug section 30 is adapted to engage and support one end of the fluorescent light bulb 50, as shown best in FIG. 4. It should thus be noted that the electrode opening 32 will be of various diameters depending on the external diameter of the fluorescent light bulb 50 to be supported by the end cap 26*a*. Such modifications in the diameter are well within the purview of the present invention and the users thereof.

Figure 4:
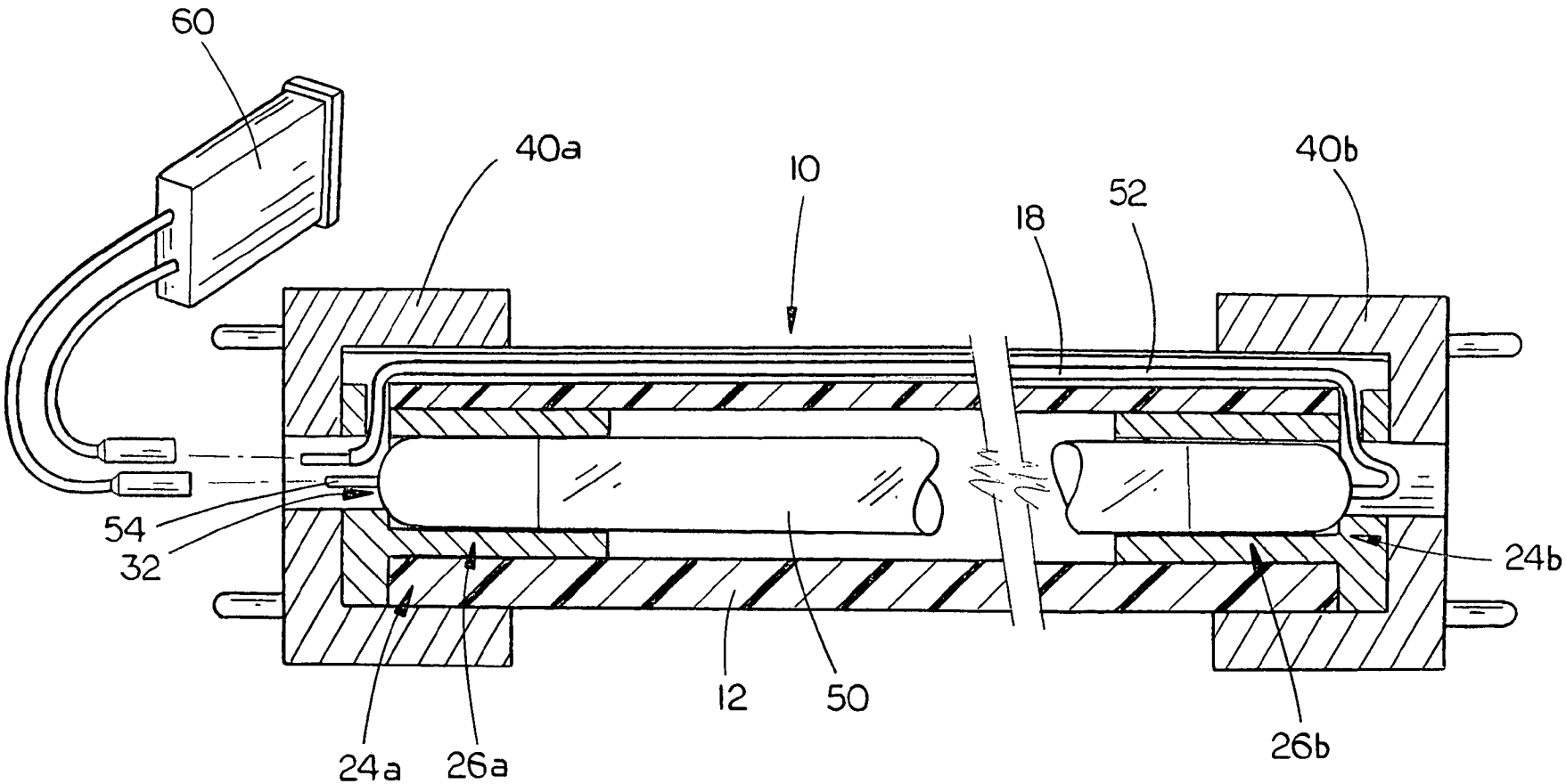
FIG. 4 is a front sectional elevational view of the present invention.

Assembly of the support and enclosure structure 10 of the present invention is shown best in FIGS. 3 and 4 as including the following steps. First, the fluorescent bulb 50 is engaged by one of the end caps 26*a* and then the fluorescent light bulb 50 is slid into hollow tube 12 until the end cap 26*a* is slid into the inner volume 16 of hollow tube 12 and flange 34 of end cap 26*a* engages the end 24*a* of hollow tube 12. The electrode 54 of fluorescent light bulb 50 adjacent end cap 26*a* thus extends through electrode opening 32 for eventual engagement by a power source. At the opposite end 24*b* of hollow tube 12, the electrode wire 52 is pulled through the electrode opening 32 of end cap 26*b* and end cap 26*b* is pushed forwards into hollow tube 12, thus engaging the opposite end of the fluorescent light bulb such that the fluorescent light bulb 50 is supported by the end caps 26*a* and 26*b* within hollow tube 12. The electrode wire 52 thus extends out of electrode opening 32 and would be fed back around and over hollow tube 12 via wire channel 18 to return the electrode wire 52 to be adjacent electrode 54 of fluorescent light bulb 50 for engagement by a power source. A wire channel cover 36 is then adhesively secured over the wire channel 18 to secure the electrode wire 52 within the wire channel 18, as shown best in FIG. 4. The wire channel cover 36 is preferably a section of adhesive electrical tape which covers the wire channel 18, although the exact nature of the wire channel cover 36 is not critical to the present invention so long as the electrode wire 52 is retained within the wire channel 18. The electrode wire 52 and electrode 54 are then connected to a wire harness 60 which is then plugged into the fluorescent light fixture in which the support and enclosure structure 10 of the present invention is to be mounted.

Additional mounting end caps 40*a* and 40*b*, as shown best in FIGS. 1 and 3, are provided which fit over end caps 26*a* and 26*b* and onto hollow tube 12 to permit the hollow tube 12 to be mounted within various types of fluorescent light fixtures. Although the mounting end caps 40*a* and 40*b* are shown as including mounting pins 44, it should be understood that many different types of mounting structures may be utilized with the present invention so long as the hollow tube 12 is securely mounted within the fluorescent light fixture via the mounting end caps 40*a* and 40*b*. In fact, in one preferred embodiment of the present invention, the mounting end cap 40*a* would include a generally U-shaped slot 42 formed in the side wall of the mounting end cap 40*a*, and this slot 42 is aligned with the wire channel 18 to permit the wire harness 60 to extend therethrough to connect to the electrode wire 52 and electrode 54 instead of extending out through the center axis hole in the mounting end cap 40*a*. This design permits the use of the present invention in situations where the wire harness 60 cannot extend out through the center axis hole due to the mounting of the present invention within a particular fluorescent light fixture. Of course, other variations of the mounting end caps 40*a* and 40*b* may be used with the present invention, and in fact these may be eliminated from use with the present invention, depending on the mounting characteristics of the particular fluorescent light fixture with which the present invention is to be used.

Figure 5:
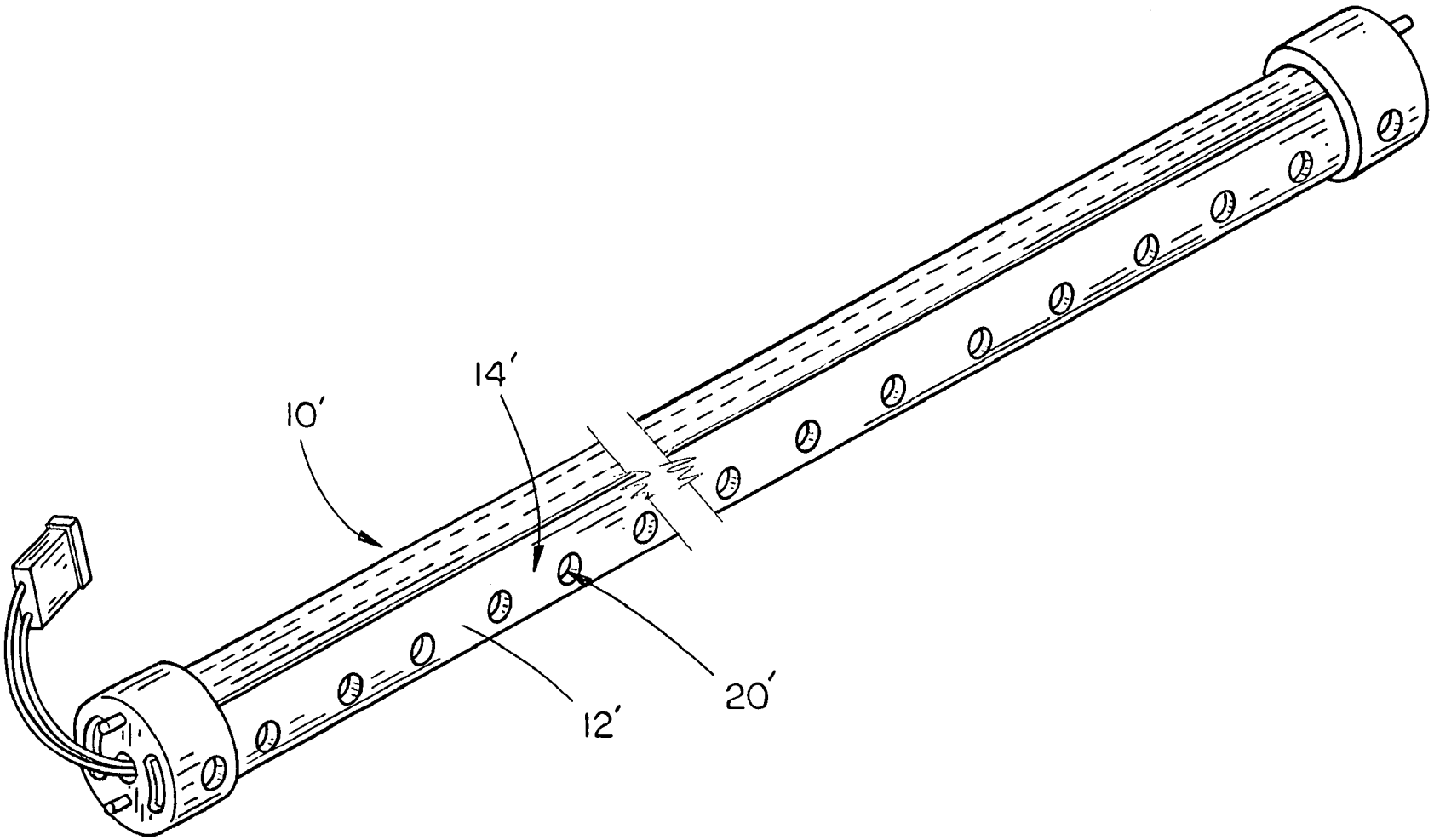
FIG. 5 is a perspective view of an alternative embodiment of the present invention.

Finally, FIG. 5 illustrates an alternative embodiment of the ventilation openings 20' of the support and enclosure structure 10' of the present invention. The hollow tube 12' of FIG. 5 would include a plurality of circular ventilation openings 20' spaced along the tube 12' which extend through outer wall 14' of hollow tube 12'. Of course, many different types of ventilation openings may be used with the present invention so long as the intended purpose of providing ventilation and surrounding air flow for the fluorescent light bulb 50 is maintained.

It is to be understood that numerous additions, substitutions and modifications may be made to the support and enclosure structure 10 for fluorescent light bulbs of the present invention which fall within the intended broad scope of the appended claims. For example, the size, shape, and construction materials used in connection with the present invention may be modified or changed so long as the intended functional features are not degraded nor destroyed. It may also be beneficial to include reflective tape or other such reflective material along one side of the hollow tube 12 to increase the light emission from one side of the hollow tube 12. Also, the exact size and shape of the end caps 26*a* and 26*b* may be modified or changed so long as the intended functionality of maintaining the fluorescent light bulb 50 in a suspended state within the inner volume 16 of hollow tube 12 is maintained. Also, the exact size and shape of the mounting end caps 40*a* and 40*b* may be modified or changed so long as the intended functionality of mounting the fluorescent light bulb 50 within the fluorescent light fixture is accomplished. Finally, as was discussed previously, the size, shape, and number of ventilation openings 20 may be modified or changed so long as the air flow around the fluorescent light bulb 50 is permitted and maintained.

There has therefore been shown and described a support and enclosure structure for fluorescent light bulbs which fulfills all of its intended objectives.

I claim:

1. A support and enclosure structure for fluorescent light bulbs comprising;

an elongated, hollow tube having opposite ends, an outer wall and an inner volume;

at least one ventilation opening extending through said outer wall and permitting air flow between said inner volume of said tube and the surrounding environment for cooling of a fluorescent light bulb held therewithin, said at least one ventilation opening being formed over at least part of the light-emitting tube of the fluorescent light bulb;

end cap means mounted on said opposite ends of said tube, said end cap means adapted to engage opposite ends of the fluorescent light bulb and support the fluorescent light bulb within said inner volume of said tube free of contact with said outer wall of said tube; and said tube constructed of generally rigid, at least partially translucent material such that light emitted by the fluorescent light bulb held within said tube generally radiates through said outer wall of said tube into the surrounding environment.

2. The support and enclosure structure for fluorescent light bulbs of claim 1 wherein said hollow tube is generally cylindrical in shape.

3. The support and enclosure structure for fluorescent light bulbs of claim 1 wherein said ventilation opening comprises a longitudinally extended slot formed in said outer wall of said hollow tube extending generally parallel with the center longitudinal axis of said hollow tube, said slot having a length of at least one-half the total length of said hollow tube.

4. The support and enclosure structure for fluorescent light bulbs of claim 1 wherein said ventilation opening comprises a plurality of holes generally longitudinally spaced along said hollow tube and extending through said outer wall.

5. The support and enclosure structure for fluorescent light bulbs of claim 1 wherein said end cap means each comprise a generally cylindrical plug having an external diameter approximately equal to or slightly greater than the internal diameter of said hollow tube, said generally cylindrical plug being generally hollow and having an electrode opening extending generally coaxially therethrough, said generally cylindrical plug further including a outer flange operative to prevent said end cap means from overextending into said hollow tube.

6. The support and enclosure structure for fluorescent light bulbs of claim 1 further comprising a wire channel formed in the outer surface of said outer wall of said hollow tube and extending along the length of said hollow tube, said wire channel operative to provide a channel for an electrode wire projecting from a fluorescent bulb housed within said hollow tube to run back along said hollow tube yet be safely retained adjacent said hollow tube to generally prevent accidental damage to an electrode wire.

7. The support and enclosure structure for fluorescent light bulbs of claim 1 further comprising mounting end cap means adapted to fit over said end cap means and on to said hollow tube facilitating mounting of said hollow tube within a fluorescent light fixture.

8. A support and enclosure structure for fluorescent light bulbs comprising;

an elongated, hollow tube having opposite ends, an outer wall and an inner volume;

at least one ventilation opening extending through said outer wall and permitting air flow between said inner volume of said tube and the surrounding environment for cooling of a fluorescent light bulb held therewithin, said at least one ventilation opening consisting of a longitudinally extended slot formed in said outer wall of said hollow tube extending generally parallel with the center longitudinal axis of said hollow tube, said slot having a length of at least one-half the total length of said hollow tube;

end cap means mounted on said opposite ends of said tube, said end cap means adapted to engage opposite ends of a fluorescent light bulb and support the fluorescent light bulb within said inner volume of said tube free of contact with said outer wall of said tube;

mounting end cap means adapted to fit over said end cap means and on to said hollow tube facilitating mounting of said hollow tube within the fluorescent light fixture; and said tube constructed of a generally rigid, at least partially translucent material such that light emitted by the fluorescent light bulb held within said tube generally radiates through said outer wall of said tube into the surrounding environment.

9. The support and enclosure structure for fluorescent light bulbs of claim 8 wherein said mounting end caps each further comprise at least one mounting pin and at least one wire slot formed in the side wall of said mounting end cap, said wire slot operative to permit electrical wires to extend therethrough to connect to the fluorescent light bulb held within said tube.

10. A support and enclosure structure for fluorescent light bulbs comprising;

an elongated, hollow tube having opposite ends, an outer wall and an inner volume;

at least one ventilation opening extending through said outer wall and permitting air flow between said inner volume of said tube and the surrounding environment for cooling of a fluorescent light bulb held therewithin, said at least one ventilation opening being formed over at least part of the light-emitting tube of the fluorescent light bulb, said ventilation opening consisting of a longitudinally extended slot formed in said outer wall of said hollow tube extending generally parallel with the center longitudinal axis of said hollow tube, said slot having a length of at least one-half the total length of said hollow tube;

end cap means mounted on said opposite ends of said tube, said end cap means adapted to engage opposite ends of the fluorescent light bulb and support the fluorescent light bulb within said inner volume of said tube free of contact with said outer wall of said tube; and said tube constructed of a generally rigid, at least partially translucent material such that light emitted by the fluorescent light bulb held within said tube generally radiates through said outer wall of said tube into the surrounding environment.

11. The support and enclosure structure for fluorescent light bulbs of claim 10 wherein said hollow tube has an outer wall thickness between one-sixth (1/6) and one-third (1/3) of the diameter of said hollow tube.

* * * * *